US011220112B2

(12) United States Patent
Secor

(10) Patent No.: US 11,220,112 B2
(45) Date of Patent: Jan. 11, 2022

(54) IN-LINE MIXING PRINTHEAD FOR MULTIMATERIAL AEROSOL JET PRINTING

(71) Applicant: National Technology & Engineering Solutions of Sandia, LLC, Albuquerque, NM (US)

(72) Inventor: Ethan Benjamin Secor, Ames, IA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 16/996,275

(22) Filed: Aug. 18, 2020

(65) Prior Publication Data

US 2021/0078337 A1 Mar. 18, 2021

Related U.S. Application Data

(60) Provisional application No. 62/899,880, filed on Sep. 13, 2019.

(51) Int. Cl.

| | |
|---|---|
| ***B41J 2/21*** | (2006.01) |
| ***B41J 2/17*** | (2006.01) |
| ***B41J 2/215*** | (2006.01) |

(52) U.S. Cl.
CPC ..... *B41J 2/211* (2013.01); *B41J 2/17* (2013.01); *B41J 2/215* (2013.01)

(58) Field of Classification Search
CPC ..... B41J 2/211; B41J 2/17; B41J 2/215
See application file for complete search history.

(56) References Cited

U.S. PATENT DOCUMENTS

| | | | | |
|---|---|---|---|---|
| 2003/0190565 | A1* | 10/2003 | Fujiwara | G03C 1/49845 430/610 |
| 2004/0012112 | A1* | 1/2004 | Davidson | B33Y 10/00 264/109 |
| 2012/0039147 | A1* | 2/2012 | Greter | B01F 13/0023 366/134 |
| 2016/0369405 | A1* | 12/2016 | Bent | C23C 18/168 |
| 2018/0246120 | A1* | 8/2018 | Bryden | H01J 49/164 |

* cited by examiner

*Primary Examiner* — Yaovi M Ameh
(74) *Attorney, Agent, or Firm* — Kevin W. Bieg

(57) ABSTRACT

An aerosol jet printhead comprising an in-line static mixer can mix multiple aerosol streams for co-deposition from a single nozzle. A printhead was designed, fabricated, and tested, demonstrating in-plane functionally graded films. The inline mixing printhead can be used with a compact aerosol jet deposition system.

5 Claims, 8 Drawing Sheets

IN-LINE MIXING PRINTHEAD FOR MULTIMATERIAL AEROSOL JET PRINTING

CROSS-REFERENCE TO RELATED APPLICATION

This application claims the benefit of U.S. Provisional Application No. 62/899,880, filed Sep. 13, 2019, which is incorporated herein by reference.

STATEMENT OF GOVERNMENT INTEREST

This invention was made with Government support under Contract No. DE-NA0003525 awarded by the United States Department of Energy/National Nuclear Security Administration. The Government has certain rights in the invention.

FIELD OF THE INVENTION

The present invention relates to aerosol jet printing and, in particular, to an in-line mixing printhead for multimaterial aerosol jet printing.

BACKGROUND OF THE INVENTION

Aerosol jet printing (AJP) uses focused deposition of micron-scale ink droplets suspended in a carrier gas flow. AJP has several advantages for printing functional devices, including versatile, non-contact digital control with high resolution. Binary multimaterial printing has been achieved by atomizing two distinct inks separately, and then converging the two ink streams prior to entering a printhead and codepositing the converged streams on a substrate, as illustrated in FIG. 1. However, such conventional multimaterial print heads have limited directional grading and can be susceptible to process drift and inadequately converged streams, resulting in inhomogeneous and nonuniform deposits.

SUMMARY OF THE INVENTION

The present invention is directed to a multimaterial aerosol jet printhead comprising an in-line static mixer for mixing two or more ink streams. For example, the mixer can comprise a helix or x-grid static mixer.

BRIEF DESCRIPTION OF THE DRAWINGS

The detailed description will refer to the following drawings, wherein like elements are referred to by like numbers.

FIGS. 7A and 7C show the particle transfer efficiency (fraction of particles passing through the mixer) for 1-5 μm diameter droplets. FIGS. 7B and 7D show the mixing efficacy for the same droplet sizes, indicating improvements in both metrics for the inverted configuration.

FIG. 8A is a radial gradient containing fluorescein and zirconia nanoparticles in a UV-curable acrylate matrix, in which the fluorescein and zirconia composition is graded from the outside in.

DETAILED DESCRIPTION OF THE INVENTION

Figure 1:
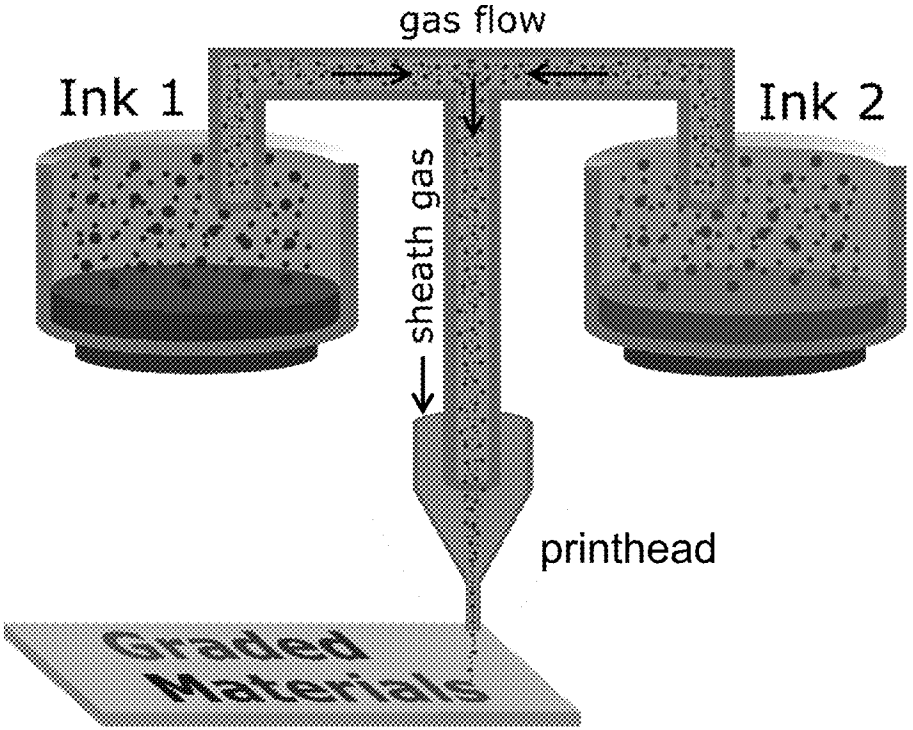
FIG. 1 is a schematic illustration of a conventional binary multimaterial aerosol jet printer.
Figure 2B:
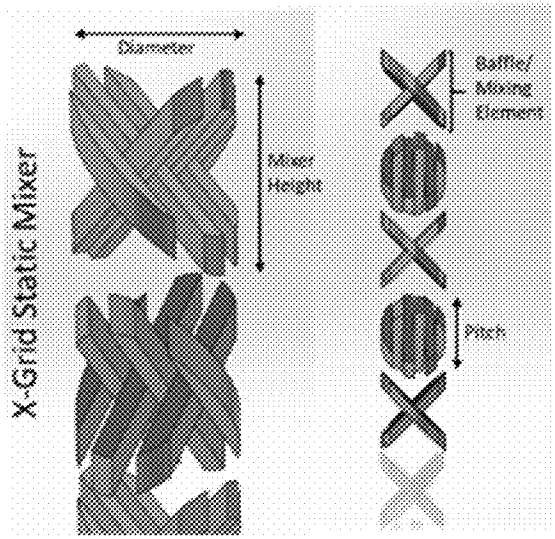
FIG. 2B is a schematic illustration of a x-grid static mixer.
Figure 2A:
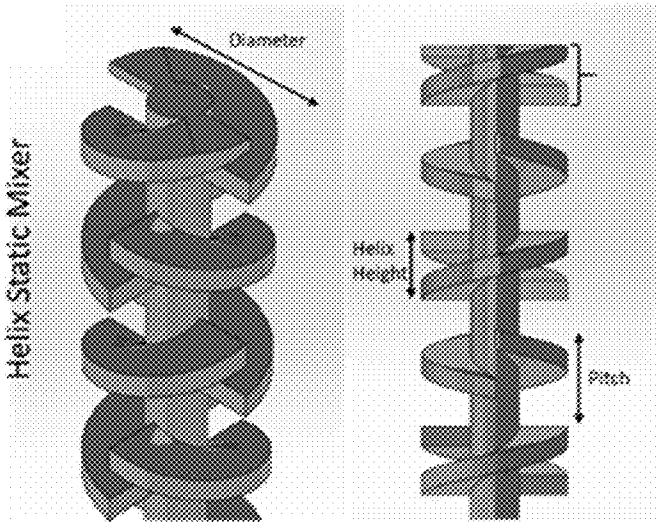
FIG. 2A is a schematic illustration of a helix static mixer.

The aerosol jet printhead of the present invention utilizes an in-line static mixer to achieve suitable mixing of multiple ink streams. The static mixer enables continuous mixing of the ink streams, without moving components. A variety of static mixer designs can be used with the invention, comprising a plurality of mixing elements or baffles contained in a hollow tube of arbitrary cross section, such as a cylindrical or square housing. For example, the mixer can comprise a helix static mixer, as shown in FIG. 2A. The helix static mixer comprises a plurality of fan-shaped baffles spirally arranged in a helix. Each pair of baffles is separated by a pitch. The helix height and diameter determine the helical angle. A wide variety of flow-directing baffle shapes can be used, such as the crossed, x-shaped vanes of the x-grid static mixer, as shown in FIG. 2B.

Figure 3B:
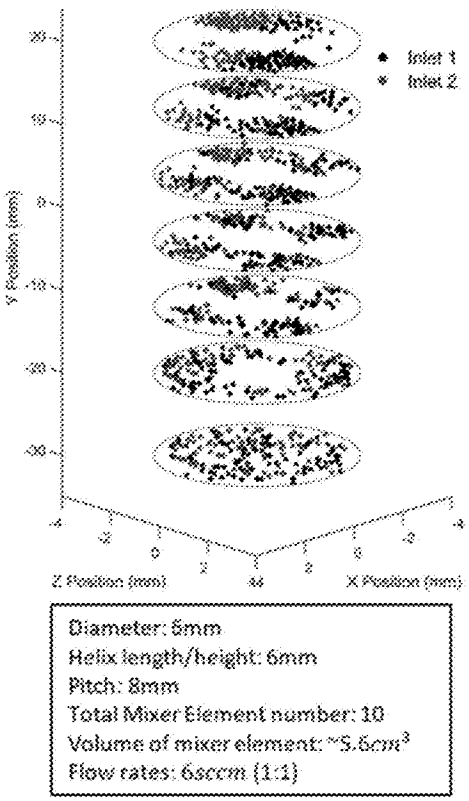
FIG. 3B is a visualization of droplet mixing as the droplets pass through the helix mixer.
Figure 3A:
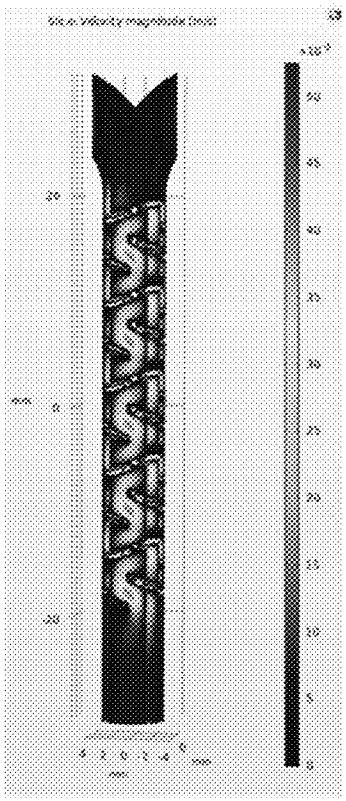
FIG. 3A is a visualization of COMSOL simulation showing flow field within the helix mixer.

Laminar static mixers were modeled using COMSOL to identify suitable geometrical parameters to achieve competing requirements: improving mixing efficacy (i.e., better mixing), decreasing droplet settling/impaction due to gravity or droplet momentum, and reducing overall volume to reduce delay time. Typical flow rates are 4-20 sccm and typical particle size is 1-5 microns. Both helix and x-grid static mixer geometries were modeled. FIG. 3A is a visualization of a COMSOL simulation showing the laminar flow field within the helix mixer. This exemplary helix mixer had a 10 mixer elements or pairs, a diameter of 6 mm, and pitch of 8 mm. As the ink streams move through the mixer, the non-moving mixing elements continuously blend the materials. An advantage of the helix mixer is that the helical elements can simultaneously produce patterns of flow division and radial mixing. FIG. 3B is a visualization of droplet mixing from two different ink streams as the droplets pass through the helix mixer. The figure shows cross sections of the ink droplet mixing at various heights in the mixer. Effective mixing of the micron-size aerosol droplets is achieved at the outlet of the mixer.

Figure 4B:
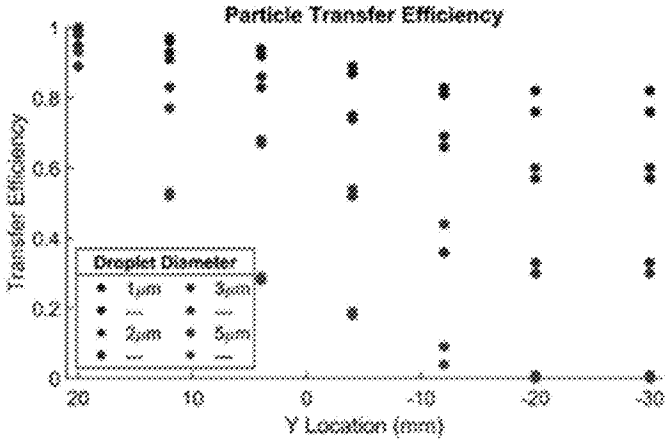
FIG. 4B is a graph of particle transfer efficiency for different droplet sizes. The mixer can be designed to operate for 1-2 micron diameter droplets, a typical size for aerosol jet printing.
Figure 4A:
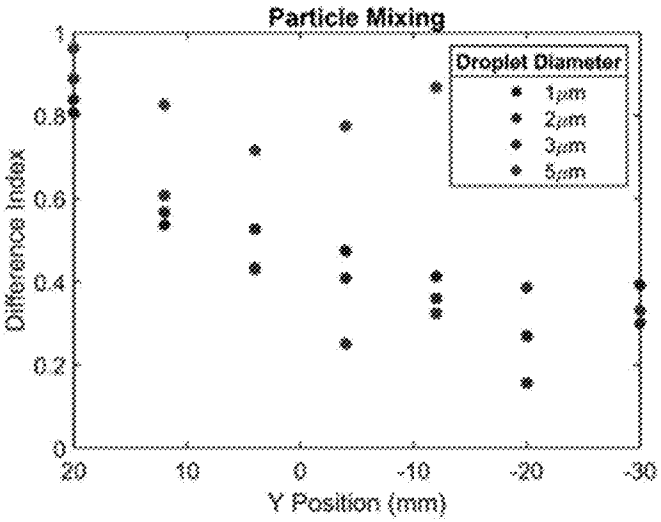
FIG. 4A is a graph of particle mixing efficacy for different droplet sizes for a helix mixer.

The simulation results were quantified based on mixing efficacy and droplet transmission yield. FIG. 4A is a graph of particle mixing efficacy for droplet sizes of 1-5 microns for the helix mixer. The difference index quantifies the mixing efficacy. Smaller droplets are effectively mixed as they move through the mixer. The difference index begins to plateau after 4-5 stages. FIG. 4B is a graph of particle transfer efficiency (i.e., fraction of particles passing through the mixer) for different droplet sizes. As expected, higher droplet settling (low transfer efficiency) is observed with larger droplets. The loss of larger droplets is due to wall impaction. Therefore, the mixer can be designed to operate for 1-2 micron diameter droplets, a typical size for aerosol jet printing. Note that turbulent flow is not required for AJP mixing because droplets are being mixed as opposed to a fluid with a homogenous density. Additionally, turbulent flow would lead to a higher droplet fallout rate.

Figure 5B:
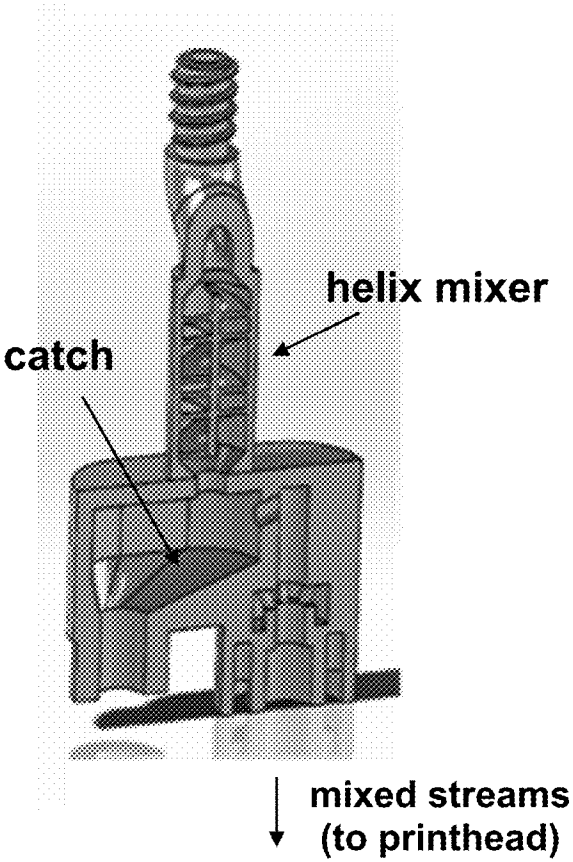
FIG. 5B is a cutaway view of the static helix mixer.
Figure 5A:
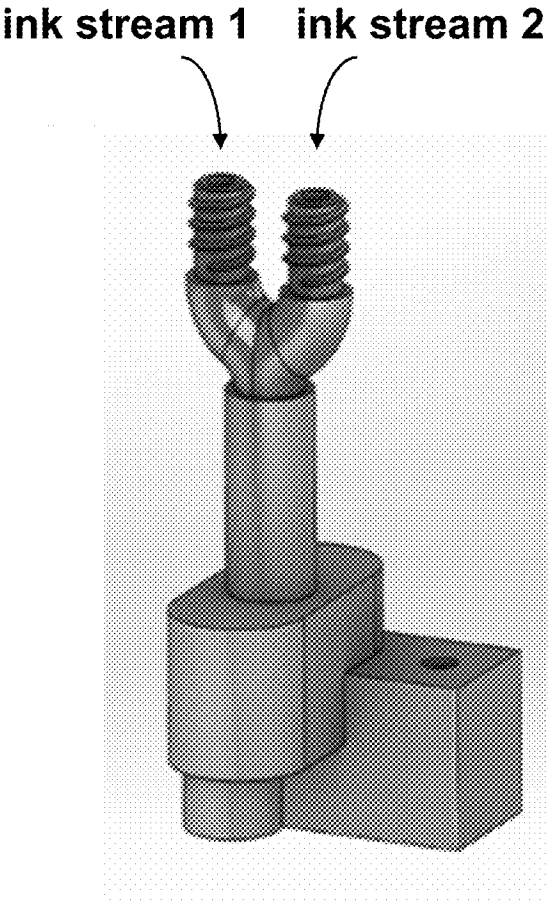
FIG. 5A is a perspective view schematic illustration of a static helix mixer that can be fabricated by stereolithography.

The mixing element can be integrated on an aerosol jet printhead. The printhead comprises a means for delivering two or more ink streams into the static mixer. The amount of each ink being delivered to the mixer can be controlled via separate mass flow controllers, such that the ratio of the ink streams can be specified and altered on the fly. In this way, parts can be digitally printed with a non-binary or graded material composition. FIGS. 5A and 5B show a solidworks geometry of the printhead incorporating a static mixer and catch, which can be fabricated by stereolithography. Because larger aerosol droplets impact the mixer walls and settle out under gravity, the printhead can employ a catch to prevent this liquid from entering the downstream portions of the nozzle. When integrated in the larger printing system, the mixer can be positioned immediately adjacent to the atomizer cartridges housing the separate inks. This proximity is critical to ensuring printing at low pressure and flow rate, and thus stable deposition over a broad range of printing parameters.

Figure 6B:
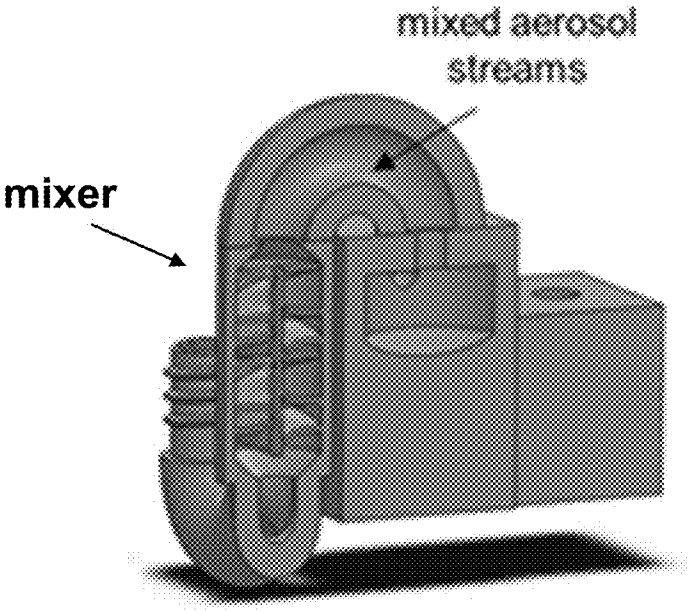
FIG. 6B is a cutaway view of the inverted static mixer.
Figure 6A:
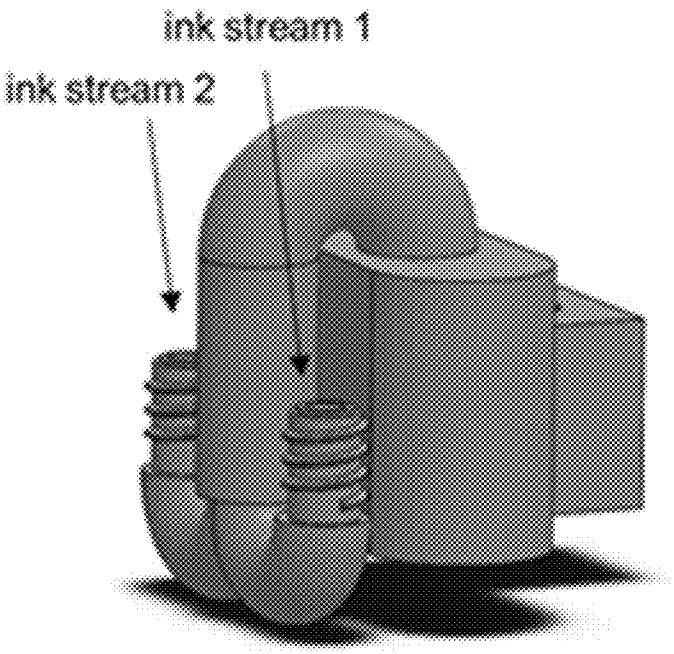
FIG. 6A is a perspective view schematic illustration of an inverted static mixer.
Figure 7A:
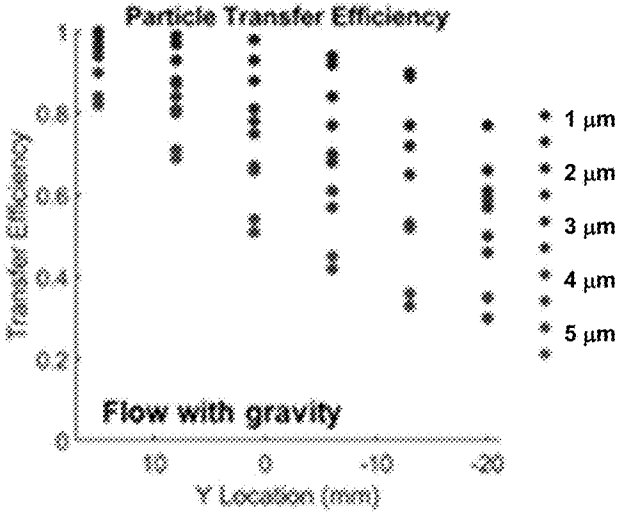
FIGS. 7A and 7B show CFD modeling results for an x-grid static mixer in a standard configuration with flow downward.
Figure 7B:
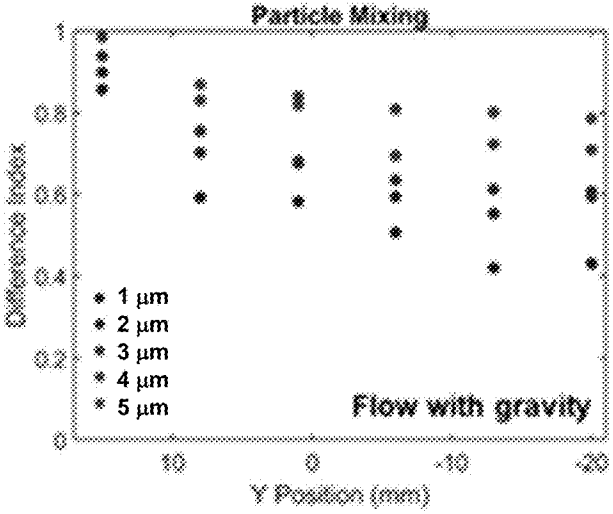
Figure 7C:
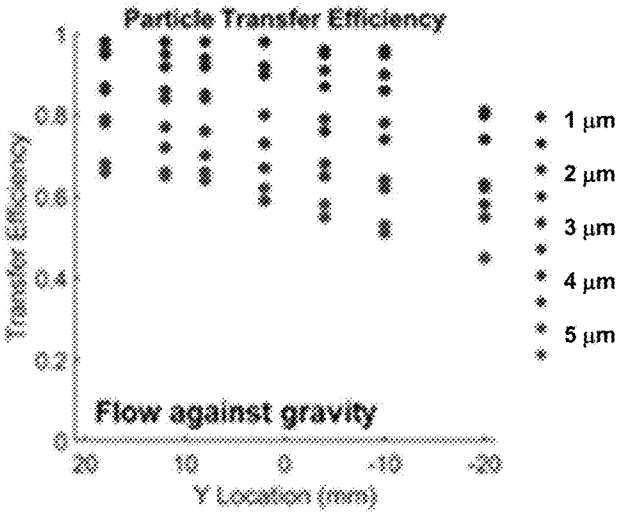
FIGS. 7C and 7D show CFD modeling results for an x-grid static mixer in an inverted configuration with flow against gravity.
Figure 7D:
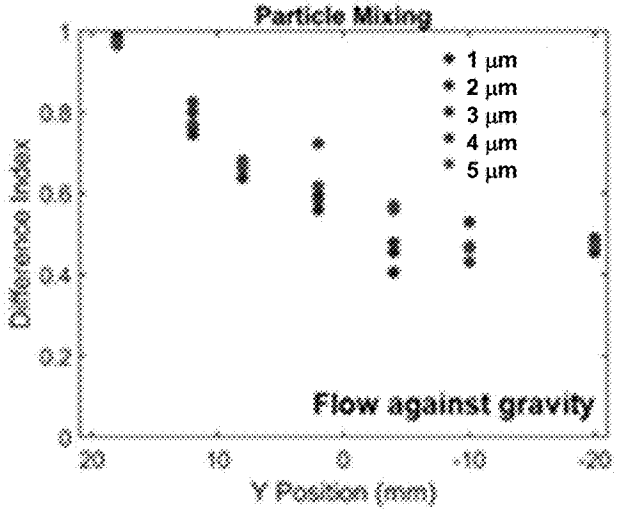

To reduce the loss of larger droplets during the printing process, the mixer can be inverted such that the flow direction is opposite gravity. FIGS. 6A and 6B are solidworks geometry illustrations of an inverted static mixer. In this way, droplet momentum and gravity are acting against each other, and fewer droplets impact the sidewalls and baffles of the mixer. FIGS. 7A and 7B show CFD modeling results for an x-grid static mixer in a standard configuration with flow downward. FIGS. 7C and 7D show CFD modeling results for an x-grid static mixer in an inverted configuration with flow against gravity. These CFD modeling results indicate that the inverted configuration results in less droplet loss and more consistent mixing of different droplet sizes.

Figure 8A:
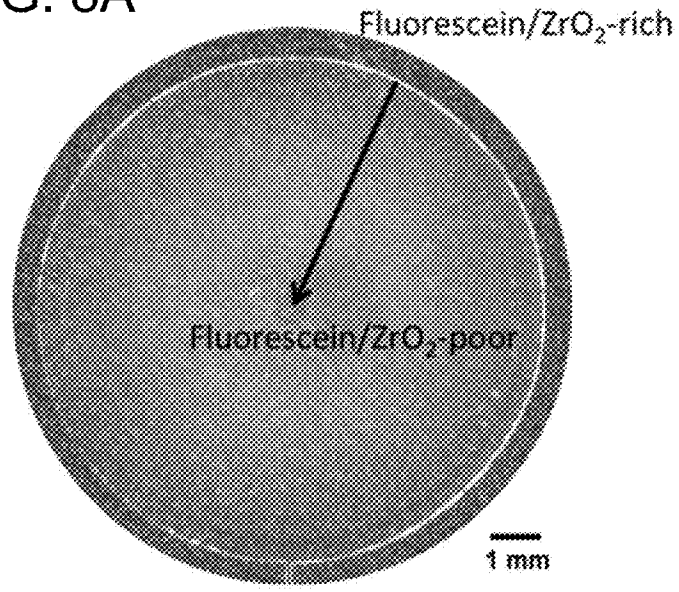
Figure 8B:
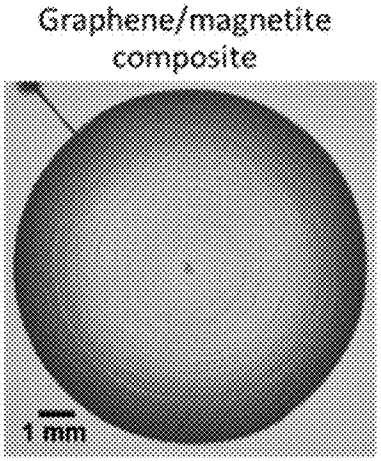
FIG. 8B is a radial gradient containing graphene and magnetite nanoparticles, in which the composition is graded from graphene (outside) to magnetite (inside). Of note here is the effective mixing of the two materials despite immiscibility of the inks.
Figure 8C:
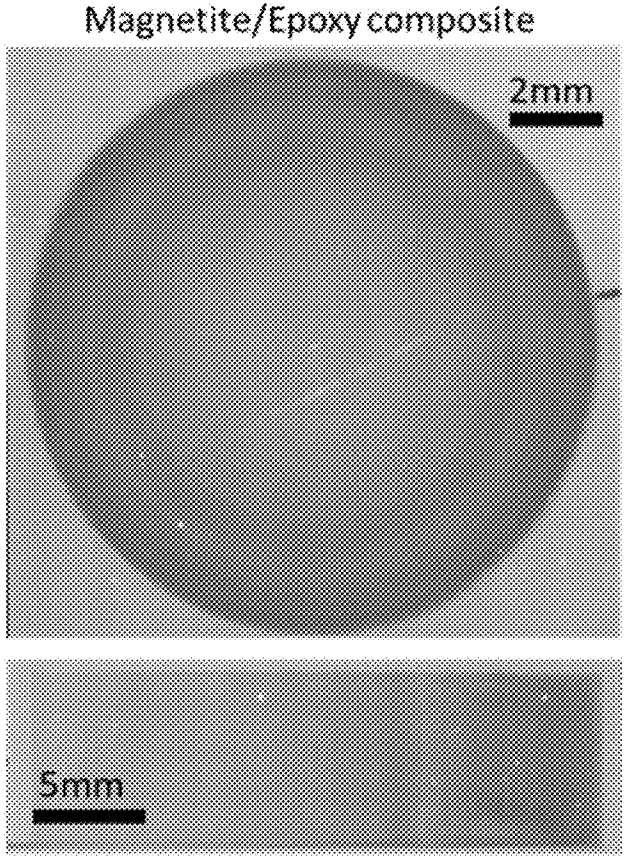
FIG. 8C is radial and linear gradients of magnetite nanoparticles in a UV-curable epoxy matrix, resulting in graded magnetic permeability.

The compact design, in-line mixing, and close integration of software control enable multimaterial printing of graded structures. While functionally-graded structures have been demonstrated before, prior reports indicate composition grading in the z-direction, which does not require the same level of integration and system performance as lateral grading. The present invention provides laterally-graded films that enable a variety of functional materials. These include optical, dielectric, magnetic, and electronic materials. In each case, lateral grading is demonstrated with a simple radial pattern. The examples include zirconia nanoparticles and fluorescein in a transparent UV-curable acrylate matrix, graphene nanoplatelets and magnetite nanoparticles, and magnetite nanoparticles in an epoxy matrix. FIG. 8A is a radial gradient of a deposit containing fluorescein and zirconia nanoparticles in a UV-curable acrylate matrix, in which the fluorescein and zirconia composition is graded from the outside in. FIG. 8B is a radial gradient containing graphene and magnetite nanoparticles, in which the composition is graded from graphene (outside) to magnetite (inside). Of note here is the effective mixing of the two materials despite immiscibility of the inks. FIG. 8C shows radial and linear gradients of magnetite nanoparticles in a UV-curable epoxy matrix, resulting in graded magnetic permeability. Grading the composition of magnetite allows tuning of the magnetic properties.

A broad range of materials can be printed using a printhead incorporating the in-line static mixer, including epoxies, acrylates, polyimides, PMMA, magnetite, silver, graphene, gold, metal oxides, and metal hydrides. The ability to mix inks at a short length-scale in the aerosol phase is enabling for a number of features. First, composites can be prepared that do not require miscibility of the components. For the example in FIG. 6B, the graphene and magnetite inks are not miscible, but they can still be forced to mix at a short length scale using the static mixer. Second, the ability to fabricate functionally-graded materials with bottom-up, 3D control of composition provides a valuable research tool for a wide range of applications in mechanical interfaces, electronics, optics, etc. Third, the static mixer printhead can be used to print species that react upon mixing, such as chemical precursors (i.e., redox chemistry or curing agents). In this way, two materials can be printed on the same gas stream but not physically mixed until they are deposited on the substrate. The ability to print different inks with mixing at a small length scale is a fundamental requirement for this type of reactive mixing. Finally, the static mixer printhead can be applied to combinatorial printing, in which two or more precursor materials are printed with varying composition ratios to build up an array of samples with different composition.

Some potential applications of graded material systems are listed below. The multimaterial aerosol jet printing capability of the present invention can potentially be useful in realizing these applications.

1) Electromagnetic wave manipulation
   a. Gradient index of refraction lenses and waveguides for optical applications
   b. GRIN materials for RF communications and sensing with graded dielectric and magnetic properties
2) Active electronics
   a. Graded semiconductors for, i.e., diodes and photovoltaics
   b. Graded thermoelectric materials
3) Catalysis and electrochemistry
   a. Tailor porosity/composition in mixed ion/electron conducting systems
   b. Engineer electronic band structure for catalysis and sensing
4) Passive electronics
   a. Reduce electric and magnetic field gradients at interfaces for magnets and supercapacitors
   b. Reduce eddy currents in magnetic materials
5) Mechanical components
   a. Thermal expansion grading at diffuse interfaces
   b. Graded modulus to reduce stress concentrations at interfaces
   c. Graded adhesives for bonding dissimilar materials The present invention has been described as an inline mixing printhead for multimaterial aerosol jet printing. It will be understood that the above description is merely illustrative of the applications of the principles of the present invention, the scope of which is to be determined by the claims viewed in light of the specification. Other variants and modifications of the invention will be apparent to those of skill in the art.

I claim:

1. A static mixer for a multimaterial aerosol jet printhead, the mixer comprising a plurality of mixing elements contained in a hollow flow tube for mixing two or more ink streams, wherein each ink stream comprises aerosolized droplets of a distinct ink material.

2. The static mixer of claim 1, wherein the mixer comprises a helix static mixer.

3. The static mixer of claim 1, wherein the mixer comprises an x-grid static mixer.

4. The static mixer of claim 1, wherein the two or more ink streams comprise aerosolized droplets of less than 5 microns in diameter.

5. The static mixer of claim 1, further comprising a mass flow controller for each of the two or more ink streams to control the ratio of the ink streams.

* * * * *